US007664379B2

(12) United States Patent
Eisenhauer

(10) Patent No.: US 7,664,379 B2
(45) Date of Patent: Feb. 16, 2010

(54) FAN HEATER

(75) Inventor: Hartmut Eisenhauer, Michelfeld (DE)

(73) Assignee: STEGO-Holding GmbH, Schwäbisch (DE)

( * ) Notice: Subject to any disclaimer, the term of this patent is extended or adjusted under 35 U.S.C. 154(b) by 317 days.

(21) Appl. No.: 11/720,245

(22) PCT Filed: Nov. 28, 2005

(86) PCT No.: PCT/EP2005/012699

§ 371 (c)(1),
(2), (4) Date: May 25, 2007

(87) PCT Pub. No.: WO2006/058687

PCT Pub. Date: Jun. 8, 2006

(65) Prior Publication Data

US 2008/0131102 A1 Jun. 5, 2008

(30) Foreign Application Priority Data

Nov. 29, 2004 (DE) ..... 10 2004 057 530

(51) Int. Cl.
*F24H 3/02* (2006.01)

(52) U.S. Cl. ..... 392/360; 392/447; 392/365

(58) Field of Classification Search ..... None
See application file for complete search history.

(56) References Cited

U.S. PATENT DOCUMENTS 2,120,795 A * 6/1938 Boothby ..... 392/369
2,260,233 A * 10/1941 Ripley ..... 392/363
2,429,733 A * 10/1947 Trent ..... 392/366
2,606,273 A * 8/1952 Franklin ..... 219/473
2,839,657 A * 6/1958 Mast ..... 392/369
2,852,657 A * 9/1958 Markel et al. ..... 392/376
3,176,117 A * 3/1965 Knoll et al. ..... 392/360
4,737,616 A 4/1988 Wen-Ying
4,739,153 A * 4/1988 Rendel et al. ..... 392/363
4,740,670 A * 4/1988 You ..... 392/365
4,876,436 A 10/1989 Ide et al.
4,928,204 A * 5/1990 Wang ..... 361/600
RE37,642 E * 4/2002 Goldstein ..... 392/367

FOREIGN PATENT DOCUMENTS

DE 1727350 U 8/1956
DE 1741786 U 3/1957
DE 1811540 U 5/1960
DE 7000378 U 9/1970
DE 2123413 A 12/1971
DE 7628832 U1 12/1976

* cited by examiner

*Primary Examiner*—Thor S Campbell
(74) *Attorney, Agent, or Firm*—Panitch Schwarze Belisario & Nadel LLP

(57) ABSTRACT

A fan heater including a housing through which air is able to flow in a longitudinal direction, a blower to propel the air and at least one heating element mounted elastically in the housing by means of a fixing element. Moreover the heating element is a PTC element and the blower is mounted separately from the PTC element in the housing. An assembly is also disclosed, which includes a fan heater as aforesaid, wherein at least two adapter plates, each exhibiting at least one fastening element for fixing the fan heater to a location intended for it and devices for fixing optionally one of the adapter plates to a housing in the fan heater, are provided.

24 Claims, 7 Drawing Sheets

Fig. 5
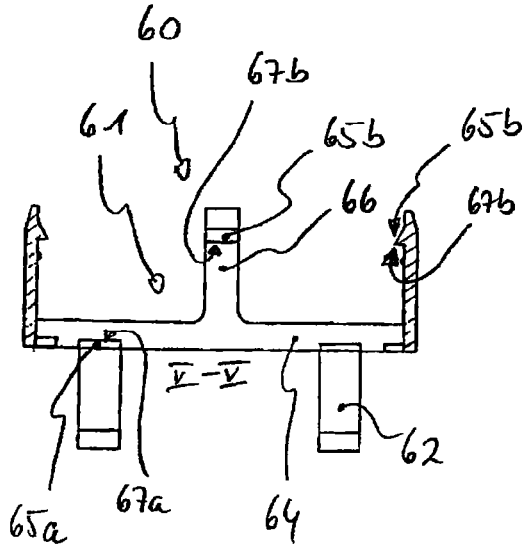
Fig. 6
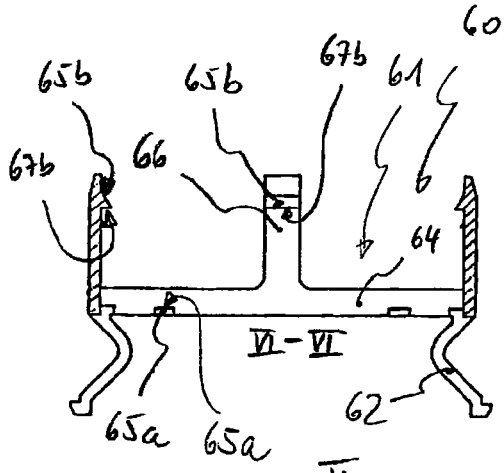
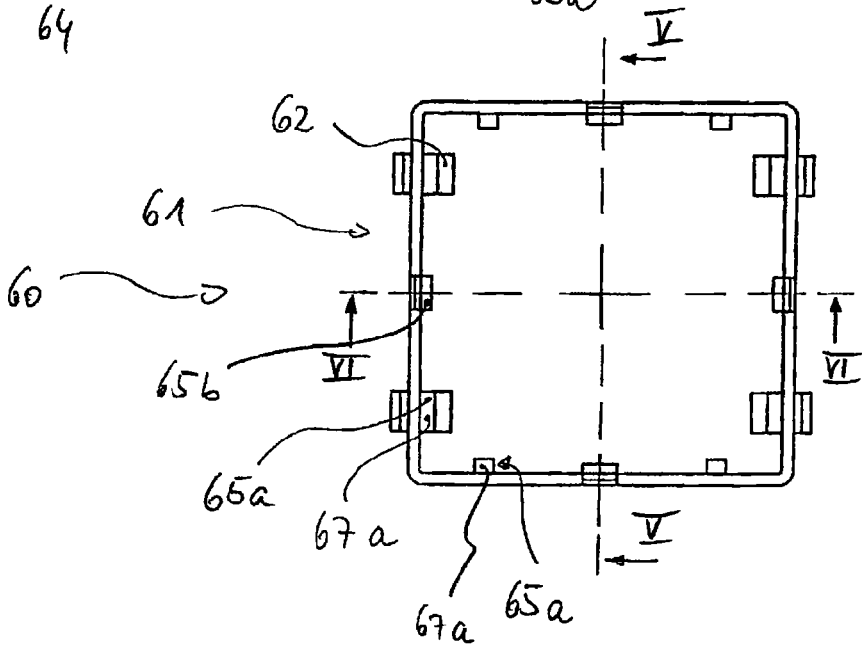
Fig. 7

Fig. 13
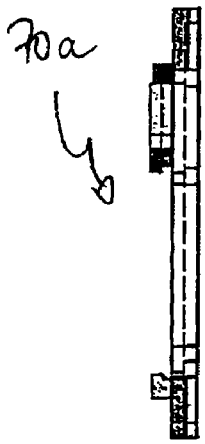
Fig. 12
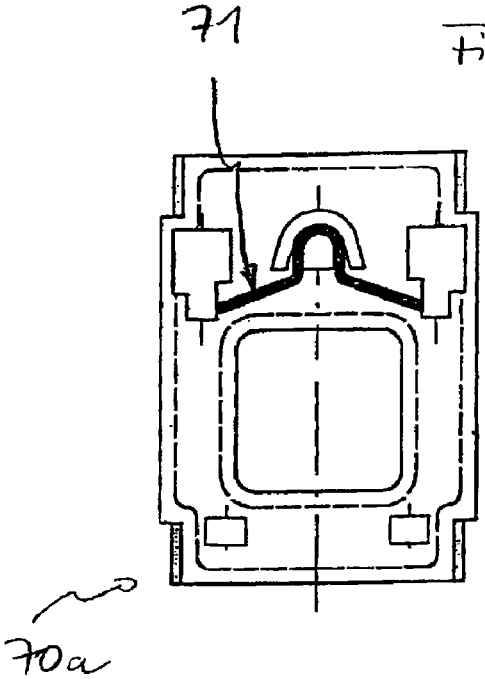
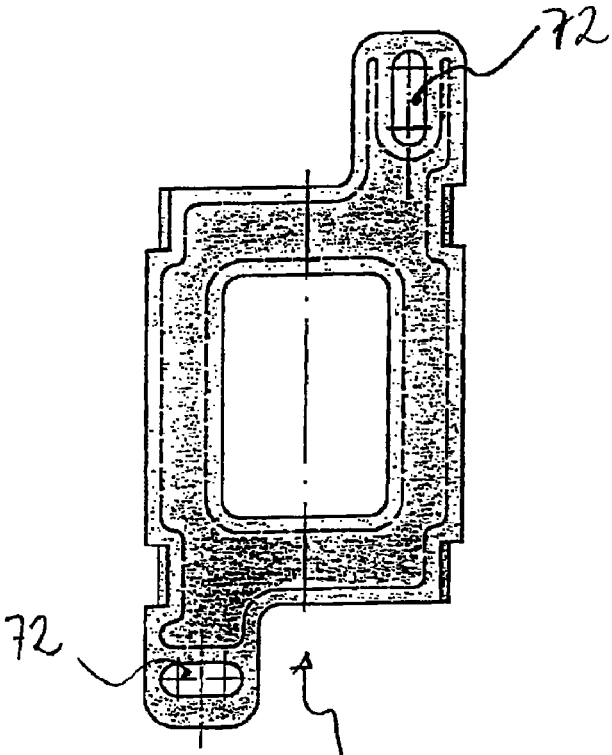
Fig. 14
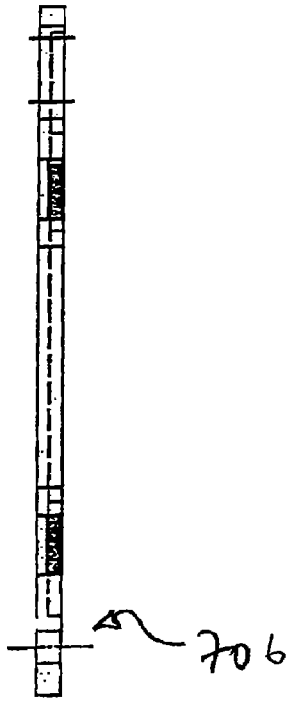
Fig. 15

FAN HEATER

CROSS-REFERENCE TO RELATED APPLICATIONS

This application is a Section 371 of International Application No. PCT/EP2005/012699, filed Nov. 28, 2005, which was published in the German language on Jun. 8, 2006, under International Publication No. WO 2006/058687, the disclosure of which is incorporated herein by reference.

BACKGROUND OF THE INVENTION

The invention concerns a fan heater and also an assembly incorporating such a fan heater.

As a rule, installations which include electrical and/or electronics equipment, for example switching cabinets or distribution boards, must be actively ventilated. As a result malfunctioning of components as a result of condensation water or due to too great a temperature drop, for example on account of low temperature, may be avoided. For ventilation and uniform temperature equalization of these installations fan heaters are usually employed, which are able to be located in any desired position in the switching cabinets.

Thus fan heaters are known for example, which exhibit a PTC (positive temperature coefficient) element as a heating element clamped in the cabinet. PTC elements operate automatically and are temperature limited, so that overheating in the switching cabinet or the distribution board may be reliably avoided.

The construction of known fan heaters of this kind is however very complex and they are difficult to handle. In particular the components of these fan heaters can be easily damaged by impacts or similar undesired influences from outside if handled inexpertly.

A commercially available electrical fan heater is well known for example from DE 1 727 350 U, in which the air to be heated is fed by a blower over an electrical resistor in a housing and is blown outside. Inside the housing a drive motor is arranged—together with the resistor, which is fixed to the motor—to the inner wall of the housing freely suspended and is elastically mounted.

Here the motor is connected to the housing, together with ventilator paddles and the resistor, via tension springs. The tension springs aligned radially with reference to the motor—uniformly spaced from one another—are fixed at one end to the inner housing wall and the other end is attached to the outside wall of the motor.

The assembly and the handling of this fan heater are also extremely complex and expensive, and the system exhibits an unfavorable damping behavior with regard to impacts and/or vibration and hence damage to individual components can also arise.

BRIEF SUMMARY OF THE INVENTION

The object of the present invention is to provide a fan heater of the kind cited at the outset which is capable of being manufactured easily and is robust.

According to the first aspect of the invention there is provided a fan heater, which includes a housing through which air may be blown in a longitudinal direction, a blower to propel the air and at least one heating element mounted elastically onto the housing by means of a fixing element. The heating element is designed as a PTC element and the blower is mounted onto the housing separately from the PTC element.

According to a second aspect of the invention there is provided an assembly, which includes a fan heater according to the first aspect, wherein at least two adapter plates, each comprising at least one fastening element for fixing the fan heater to an intended place and devices for fixing one of the adapter plates to a fan heater housing are provided.

Hence, the fan heater has an extremely simple construction and method of functioning on account of the PTC element and due to the element being mounted separately from the fan. The operation of the fan heater is eased by the special physical features of the PTC element. A PTC element is therefore especially suitable particularly for temperature equalization of the sensitive electronics in a switching cabinet as described above.

On account of the mounting according to the invention any impacts and/or vibrations are now not able to be transmitted directly to the PTC element, because on the one hand the mounting permits a relative movement between housing and heating element. On the other hand the impact/vibration protection is guaranteed to a great extent with the mounting according to the invention being deposited explicitly on the heating element, because the PTC element is mounted within the fixing element on its own, and consequently undesired interactions between heating element and other components, such as the blower, are able to be avoided, especially if the fan heater is applied inexpertly.

With the fan heater fixed in various ways to a place intended for it, as is intended in the assembly, a reliable fixing of the fan heater is enabled depending upon various ambient conditions. As a result an additional protection of the heating element mounted in the fan heater is able to be achieved.

The present invention also relates in particular to the mounting of a PTC element, which is developed from filigree work ceramic staves, so that the PTC element ultimately exhibits a latticework structure or is intended as a honeycomb body. As a result the PTC element exhibits a low impedance to air flow and can thus permit an adequate airflow.

In a first preferred embodiment the fixing element includes at least one seating element substantially solidly joined or able to be joined to the heating element, which is elastically mounted with respect to the housing. The seating element guarantees a secure retention of the heating element at a place in the fan heater intended for this, with simultaneous freedom of movement. As a consequence the mounting of the heating element thus developed can counter the influencing forces from outside.

In a further preferred embodiment the seating element includes a frame having clips, which are developed such that the heating element is able to be snapped into the clips and thus be joined firmly to the frame. The clips are flexibly bendable for inserting the heating element and recapture their original shape when the heating element is located. A secure retention of the heating element in the fixing element is guaranteed by means of the clips.

The frame designed to have clips serves to join the clips together and is preferably designed integrally with these. Consequently the frame is able to be fabricated in a simple and cost effective way. Preferably the frame runs along the walls of the housing, so that the heating element may be designed to have the maximum possible area within the housing. Accordingly the frame comprises four frame sides.

Alternatively it is possible to design the clips as separate elements, so that these may be for example attached to the frame. Thus various clip sizes are able to be inserted for different types of load and embodiments of the heating elements.

Preferably the seating element exhibits lower clip elements and upper clip elements, wherein the lower clip elements are designed directly on the frame and the upper clip elements are designed to be spaced from the frame by means of at least one spacing element arranged on the frame. The upper and lower clip elements guarantee that the heating element is held securely within the seating element and in particular will prevent a longitudinal displacement of the heating element within the housing, i.e. in the longitudinal direction of the housing through which air is able to flow. The orientation of the lower and upper clip elements is defined with respect to the longitudinal direction of the housing, whereby the longitudinal direction of the housing corresponds to an airflow direction through the fan heater.

If the clips or clip elements are able to be attached to the frame as separate elements, heating elements of various thicknesses may then be accommodated in the seating element with the help of spacing elements of different lengths, oriented in the housing direction. A frame which is mounted once only in the housing is thus able to be employed for different heating elements.

Preferably the lower clip elements and the upper clip elements are arranged, alternating respectively in the frame. For example two lower clip elements and one upper clip element lying between them are provided per frame side.

As a result it is possible for the heating element to be retained securely through simple means.

Alternatively it is possible for the clips to be arranged on the frame such that one lower clip element and one upper clip element respectively face one another. This ensures that the heating element is retained especially securely in the fixing element, if several clip elements facing one another are provided for each frame side.

The clips preferably exhibit seating surfaces or contact areas oriented only in the direction of the heating element span, i.e. vertical to the spacing elements such that the heating element will then lie on the lower clip elements and be supported against the upper clip elements. The design of the seating surfaces or contact areas oriented in this way makes it easier for the heating elements to be inserted into the fixing element, which ensures that the heating element is retained with adequate security in the fixing element.

A particularly secure seating is able to be achieved, wherein a continuous lower seating surface is designed in the frame instead of individual clip elements. The heating element then overlaps a lower surface completely on the seating surface.

A solution is provided according to the invention, which exhibits resilient means integrally formed on the frame to provide an anti-vibration connection to the housing. As a result the seating element is connected firmly to the housing and is nevertheless able to move relative to the housing, as already mentioned above, so that forces acting upon the seating element and hence on the heating element can be countered.

The resilient elements are advantageously designed integrally with the frame. This enables the fixing element to be fabricated extremely cost effectively and simply. Preferably the resilient elements are designed and attached to the frame such that they serve simultaneously as lower clip elements and hence also as seating surfaces for the heating element.

If the resilient elements are designed as separate elements able to be attached to the frame, different types of anti-vibration elements are able to be employed and also replaced according to type of load. The resilient elements can be attached to the frame coming from above or however just as well arranged underneath the frame.

A preferred embodiment provides resilient elements which are able to be locked to holding devices in the housing. At the same time the housing defines e.g. recesses, into which the resilient elements may be snapped. In this way the fixing element assembly is able to be removed easily from the housing, so that the heating element may be inserted for example outside the housing. The fixing element is then able to be inserted into the housing together with the heating element. Also in this manner the fixing element is able to be exchanged by simple means as a complete entity.

In order to achieve an optimum elastic effect the frame is connected only to two opposing housing walls, whereby at least two resilient elements are provided for connecting the frame to one housing wall respectively. Having two resilient elements per housing wall guarantees that the frame is held adequately in or on the housing, while connecting the frame to only two housing walls which face each other permits its freedom of movement adequately.

Preferably the resilient elements are constructed from plastics. Plastics enable a stable embodiment of a resilient component with simultaneously low bulk. It is also conceivable to mount the frame via metal helical springs.

In one advantageous embodiment the fixing element includes a plurality of separate seating elements, which are able to be fixed respectively to the heating element and comprise springs to be supported on the housing. In this embodiment also the fixing element consists of the seating elements and the corresponding springs. In this embodiment the fixing element can be attached completely to the heating element outside the housing, so that the heating element complete with the fixing element may be inserted into the housing by simple means. Preferably one seating element and one spring are provided respectively at each corner of the, for example, square or rectangular designed disc-shaped heating element. Consequently an adequate retention of the heating element in the housing is also guaranteed here, whereby the springs can cushion any impacts transmitted by the housing.

A preferred embodiment provides for the springs to be retained in relation to a displacement in the longitudinal direction in the housing by at least one separator which is able to be inserted in the housing. That is, the springs are mounted in or on the separator, so that the heating element is elastically mounted likewise. As a result the separator is supported again against the housing and/or against further fan heater components. Advantageously the heating element is mounted over the springs in sandwich structure between two separators, whereby both separators are supported against the housing and/or further fan heater components. The separator or separators exhibit advantageously protruding elements to retain the springs, whereby the protruding elements are designed integrally with the separator and/or as a separate element able to be attached to the separator.

For a cost effective and reduced component count embodiment of a fan heater designed with a elastically mounted heating element, this may be designed by utilizing two separators, one separator being designed as a guard screen the other as an air deflection panel. The guard screen visible from outside for protection against intrusion into the fan heater will then exhibit the protruding elements, e.g. pegs, on a lower surface with respect to the longitudinal direction of the housing, which elements press against the springs on an upper surface of the heating element. The springs designed on a lower surface of the heating element then overlap for example an upper surface of the air deflector panel, with respect to the longitudinal direction of the housing, or to the seating surfaces intended explicitly for this purpose, and are clamped by pegs additionally designed on the air deflector panel.

The air deflector panel helps towards an adequate air feed and air turbulence in the fan heater. As a result it is guaranteed that the air sucked from a blower is fed through the fan heater as required.

As described above, the heating element exhibits springs on the under surface as well as the upper surface. In one advantageous embodiment the springs are designed as disc elements, so that a part of the disc covers the upper surface and another part of the disc covers the lower surface of the heating element. That is to say, only one spring is provided at each mounting point, which covers the upper surface and also the lower surface in relation to the longitudinal direction of the housing. The disc elements are accordingly fixed via each of their centre points to the heating element via the seating element. Alternatively it is possible to design the springs as hemispherical elements, whereby the hemisphere surface areas are each turned towards the heating element.

Furthermore as one of the preferred embodiments it is intended that the air deflection panel is designed to retain the blower against a displacement in the longitudinal direction in the housing. At the same time the air deflection panel is latched for a fixed location inside the fan e.g., into the housing walls and comprises a spring device for bracing the blower in the housing. Any play of the blower in the housing due to assembly can be compensated for on account of the spring device on the air deflection panel, so that the fan heater does not exhibit clattering components.

Preferably the air deflection panel is designed from plastics, since plastics are an extremely stable and at the same time light material. If the spring device is integrally formed on the air deflection panel, it is thus preferable if this is also designed from plastics. A spring mechanism provided as a separate element may, for example, be designed also as at least one metallic helical spring or similar spring device. A disc spring or a cup spring assembly (also known as a Belleville cup spring assembly) is also suitable for the play-free blower mounting.

A solution is provided according to the invention wherein at least one housing wall of the fan heater exhibits at least one fastening device on an outer side for retaining an adapter plate, whereby the adapter plate exhibits at least one fastening device for fixing the fan heater to a point intended for this purpose. The fastening devices may be designed for example as locating hooks on the housing wall, upon which the respective adapter plate is able to be hung.

If various adapter plates with different fastening elements are provided, the appropriate fastening element can be selected according to requirement and can be attached via the adapter plate to the fan heater housing. The adapter plates are accordingly designed independently of their fastening elements, such that any adapter plate may be fixed to the housing.

The fastening elements may be provided, for example, as clip fasteners by means of a flexible and/or foldable leaf spring, whereby the fan heater is then able to be fixed preferably to a rail, e.g. in a switching cabinet. The fastening elements may also exhibit at least one slot, so that the fan heater is able to be fixed by designing a screw fixing to a point intended for this purpose.

A solution provided according to the invention, wherein the fixing resilient elements are made from plastics, for example from an elastomer, such as rubber or silicone. These materials allow an adequate spring effect and additionally are light and cost effective.

Preferably the seating element is, or the seating elements are designed from plastics. Plastics materials are extremely stable and break-proof materials and at the same time of low bulk. To that extent seating elements made from plastics can guarantee a secure retention of the heating element and be mounted elastically without problems.

Besides which the fan heater housing is also preferably designed from plastics. As a result stability and a low bulk are guaranteed for the fan heater.

PTC elements are manufactured for example from barium titanate as base material while adding further metal oxides. As already described above, the heating element in the case of the fan heater according to the invention is designed preferably as a mesh or honeycomb body and therefore exhibits an extremely filigree structure. The mesh structure enables an adequately high airflow in the fan heater with low flow-impedance. To this extent it is precisely with a heating element designed in this way that the mounting in accordance with the invention is of advantage, in order to avoid an impairment of the heating element function.

The PTC element is characterized by an abrupt increase in the resistance within a very limited temperature range. As a result the PTC heating element is suitable as a self-regulating heating element, so that overheating, e.g., particularly inside the switching cabinet, is able to be avoided. Particularly with a PTC element the temperature of sensitive electronics can be equalized by simple means.

In a preferred embodiment of the assembly already described above the fastening element on the appropriate adapter plate is provided as a flexible and/or foldable leaf spring with a clip fastener and/or as at least one slot for a screwed connection with a desired locating place for the fan heater. A clip fastener capable of being formed by the leaf spring enables a swift relocation for the fan heater, while a screw connection will guarantee an especially stable fixing.

The clip fastener in the case of a leaf spring, is thus a flexible bracket, preferably accomplished by clamping or deformation of for example a Ω-formed zone of the leaf. Furthermore the leaf is preferably made from spring steel.

A further preferred embodiment of the assembly is provided, wherein the devices for the fixing include optionally on one of the adapter plates on the fan heater housing at least one location hook on the fan heater housing and at least one recess and/or a projection or similar element on the adapter plates as a counterpart for at least one location hook. As a result the adapter plate is able to be attached to the fan heater with the appropriate fastening element according to requirement. Alternatively it is possible to screw the adapter plates to the housing.

The invention will now be described with the aid of embodiment examples, which are explained in more detail with the aid of the diagrams.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 5 is a side view of the fixing element according to the intersection line V-V from FIG. 7;

FIG. 6 is a sectional side view of the fixing element according to the intersection line VI-VI from FIG. 7;

FIG. 7 is a plan view of the fixing element;

FIG. 12 is a front view of an adapter plate designed with a fastening element for attaching to the fan heater in a first preferred embodiment for attaching to the fan heater;

FIG. 13 is a side view of the adapter plate;

FIG. 14 is a front view of an adapter plate designed with a fastening plate for attaching to the fan heater in a second preferred embodiment; and FIG. 15 is a side view of the adapter plate.

DETAILED DESCRIPTION OF THE INVENTION

The same reference numbers are used for parts which are the same and for parts which have the same function in the following description.

Figure 1:
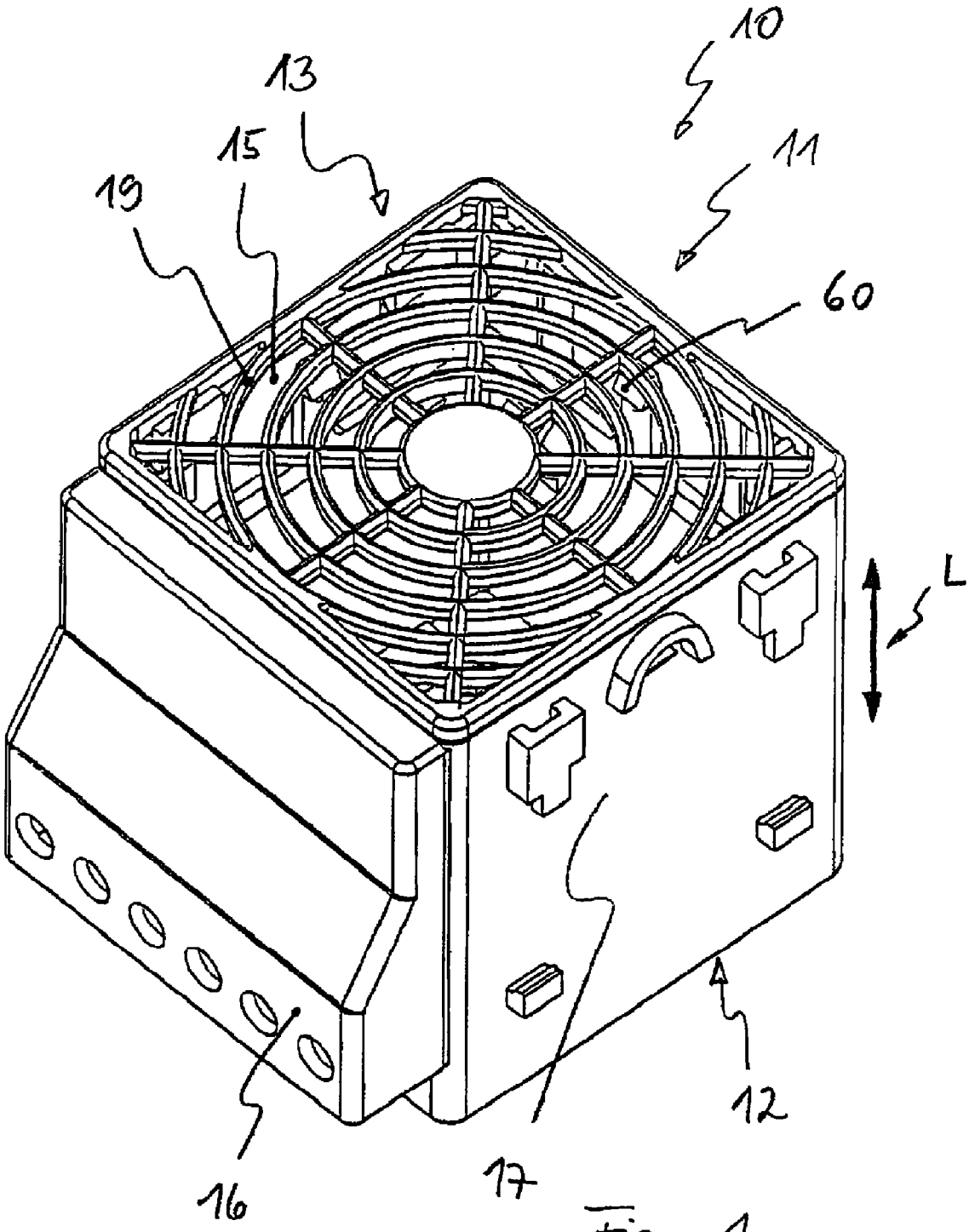
FIG. 1 is a fan heater shown in perspective in a first preferred embodiment with a partial view of a fixing element for mounting a heating element.

FIG. 1 shows a perspective view of fan heater 10 in a first preferred embodiment, wherein a fixing element 60 for mounting a heating element (not shown) is at least partly visible. The fan heater 10 exhibits a housing 11 in this embodiment example designed essentially cuboidally, e.g. from plastics, in which a terminal strip 16 for a power supply is provided on one side wall of the housing 11 both for accommodating the fan or blower (not shown) and for the heating element, likewise able to be incorporated in the housing 11. A cover of the terminal strip 16 is designed for example from plastics. A further side wall exhibits a fastening device 17, in order to fix the fan heater 10 to a place intended for this purpose e.g., in a switching cabinet. The fastening device 17 in this case is designed, such that for example a flexible metal bracket (not shown) is able to be attached to the device 17, in order to enable a clip fastening at the desired place. The bracket with a Ω-shaped zone for example may be clamped by a flexible deformation at an appropriate place in the switching cabinet. An adapter plate (not shown) however is also able to be assembled over the fastening device 17, wherein this adapter plate then exhibits a corresponding fastening element, in order to fix the fan at the place provided for it, e.g. inside the switching cabinet. According to requirement, various fastening elements are provided to be able to fasten via different plates to the fan heater housing. To that extent the plates are designed, such that they may be replaced without problems. A more detailed description of the implementation of the various fastening elements now follows.

An upper guard screen 19 is provided on an upper surface 13 of the fan heater 10 specific to a longitudinal direction L of the housing, in order to prevent an intrusion from outside into the fan heater 10. The fixing element 60 for the heating element is visible through the guard screen 19. The upper surface is defined in relation to the longitudinal direction L of the housing 11, wherein the longitudinal direction L of the housing corresponds to an airflow Pe or Pa (cf. FIG. 8) through the fan heater 10.

Figure 2:
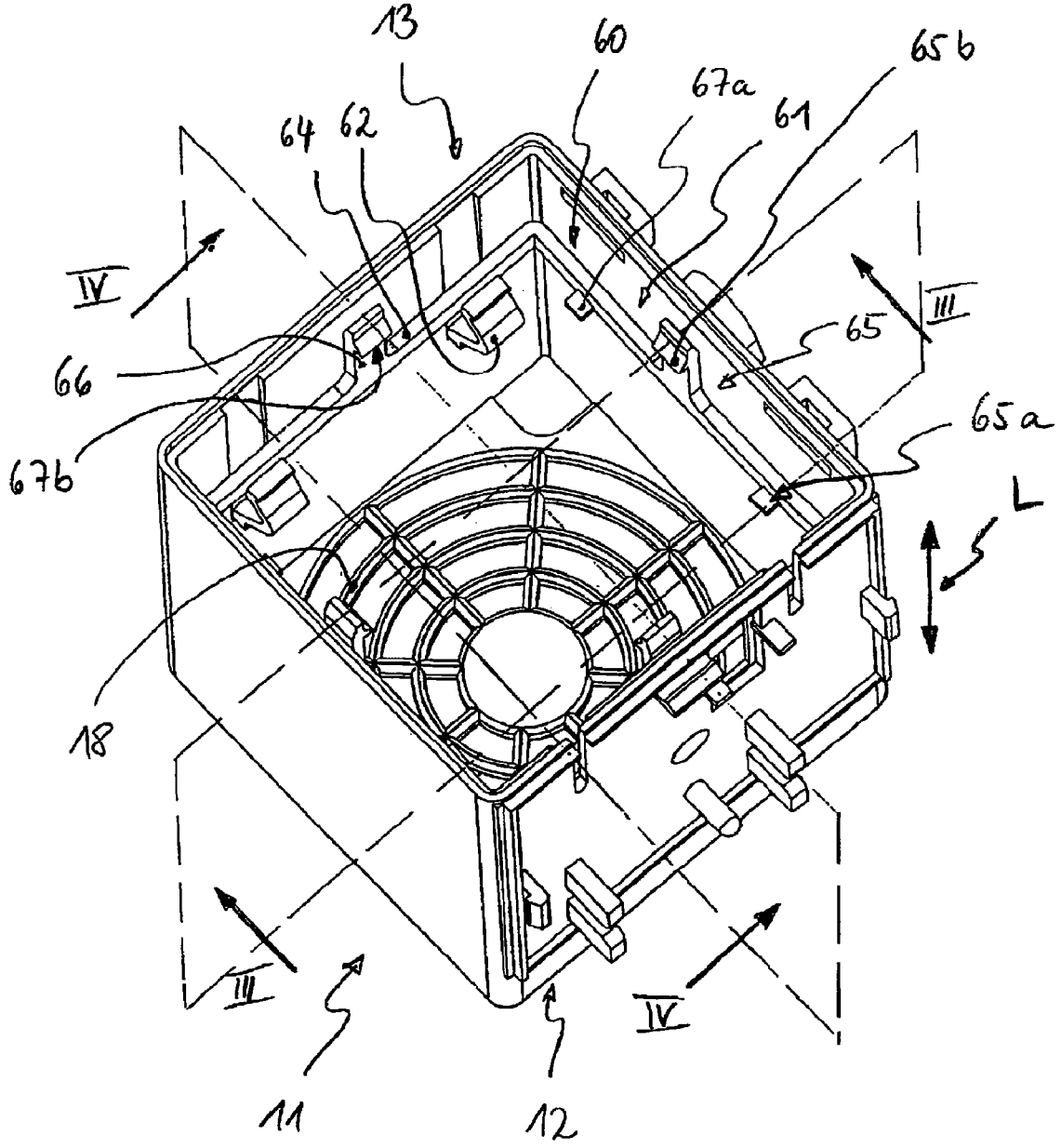
FIG. 2 is an internal view of a fan heater housing in perspective according to the fan heater of the first embodiment.

In FIG. 2 a perspective internal view of the fan heater housing 11 according to the fan heater of the first embodiment with the fixing element 60 according to the invention is shown, but without the upper guard screen. Only a lower guard screen 18 closes off the housing 11 on a lower surface 12, specific to the longitudinal direction L of the housing 11, wherein the lower guard screen 18 is designed preferably integrally with the housing 11. The perspective view shows the fixing element 60 for retaining the heating element (not shown), wherein this includes a seating element 61 with a frame 64 and clips 65, in which the clips 65 are designed such that the heating element is able to be snapped into these and thus able to be connected firmly to the frame and consequently to the seating element 61.

So that the heating element can be inserted, the clips 65 are preferably flexible and bendable and enclose the heating element, while they return to their original shape after the heating element is inserted. As a result the heating element is fastened securely in the fixing element 60. The clips 65 are joined integrally to each other by the frame. Preferably the frame 64 runs along the walls of housing 11, so that the heating element may be designed with the largest possible surface area inside the housing 11. Accordingly the frame 64 comprises four frame sides.

Alternatively it is possible to design the clips as separate elements, so that these may be attached for example to the frame. As a result various clip sizes may be inserted for different types of loads and heating element embodiments.

As is apparent from FIG. 2 the seating element 61 exhibits lower clip elements 65*a* and upper clip elements 65*b*, specific to the longitudinal direction L of the housing. The lower clip elements 65*a* are formed onto the frame 64 directly, while the upper clip elements 65*b* are designed to be spaced from the frame 64 by means of a spacing element 66 arranged on the frame 64. As a result the heating element is able to be braced securely between the lower clip elements 65*a* and the upper clip elements 65*b*, wherein in particular a displacement of the heating element in the longitudinal direction, but also a displacement transversally to the longitudinal direction inside the housing 11 is avoided.

If the clips or clip elements and/or also the spacing elements are able to be attached to the frame as separate elements in the alternative embodiment, heating elements of different thicknesses may be integrated in the seating element with the aid of spacing elements of various lengths. A frame which is assembled once in the housing is thus able to be utilized for different heating elements.

The clip elements 65*a*, 65*b* are arranged alternately on the frame 64 according to FIG. 2. Thus two lower clip elements 65*a* are facing one upper clip element 65*b* respectively on each frame side. As a result a secure retention of the heating element is guaranteed by simple means.

Alternatively clip elements which face each other may be provided for each frame side, i.e. one lower clip element lies opposite one upper clip element. To fasten the heating element securely at least two pairs of opposite clips are to be provided for each frame side. As is apparent from FIG. 2, the clips exhibit seating areas or contact surfaces 67*a*, 67*b*, so that the heating element overlaps on the lower clip elements 65*a* and is supported by the upper clip elements 65*b* via their contact surfaces 67*b*.

The seating areas 67*a* of the lower clip elements 65*a* are designed integrally with resilient elements 62 in accordance with FIG. 2, for fixing the seating element 61 flexibly to the housing 11, wherein two resilient elements 62 are designed on two opposing frame sides respectively. As a result an optimum anti-vibration mounting of the seating element 61 is guaranteed with at the same time a secure fixing to the housing 11. The other two frame sides facing each other, designed without resilient elements, exhibit exclusively clip elements 65*a*, 65*b*, wherein the lower clip elements 65*a* are designed as seating surfaces 67*a* for the heating element.

Due to the particular design of the resilient elements 62 the frame 64 is arranged to be spaced from the housing 11 and mounted flexibly on it. The resilient elements 62 thus connect the seating element 61 to the housing 11 in this embodiment. Accordingly the seating element 61 is able to move relative to the housing 11, so that the seating element 61 can cushion external influences, such as impact forces. As a result the heating element mounted in the seating element 61 is protected against the external influences.

The resilient elements 62 are designed integrally with the frame 64, and extend outwards from the frame 64 in an arch shape and are eventually joined to the housing 11. Moreover the housing 11 exhibits for example, recesses, into which the resilient elements 62 are able to snap. Thus the complete fixing element 60 is able to be easily removed easily from the housing 11 or inserted. The heating element may be inserted for example into the fixing element 60 outside the housing 11, so that then this together with the heating element is able to be inserted into the housing 11. The fixing element 60 can thus be exchanged as an entity.

If the resilient elements are designed as separate elements, able to be attached to the frame, different types of springs are able to be inserted and also exchanged according to requirements. Besides which, several heating elements may also be arranged by means of several fixing elements in the fan heater.

Figure 3:
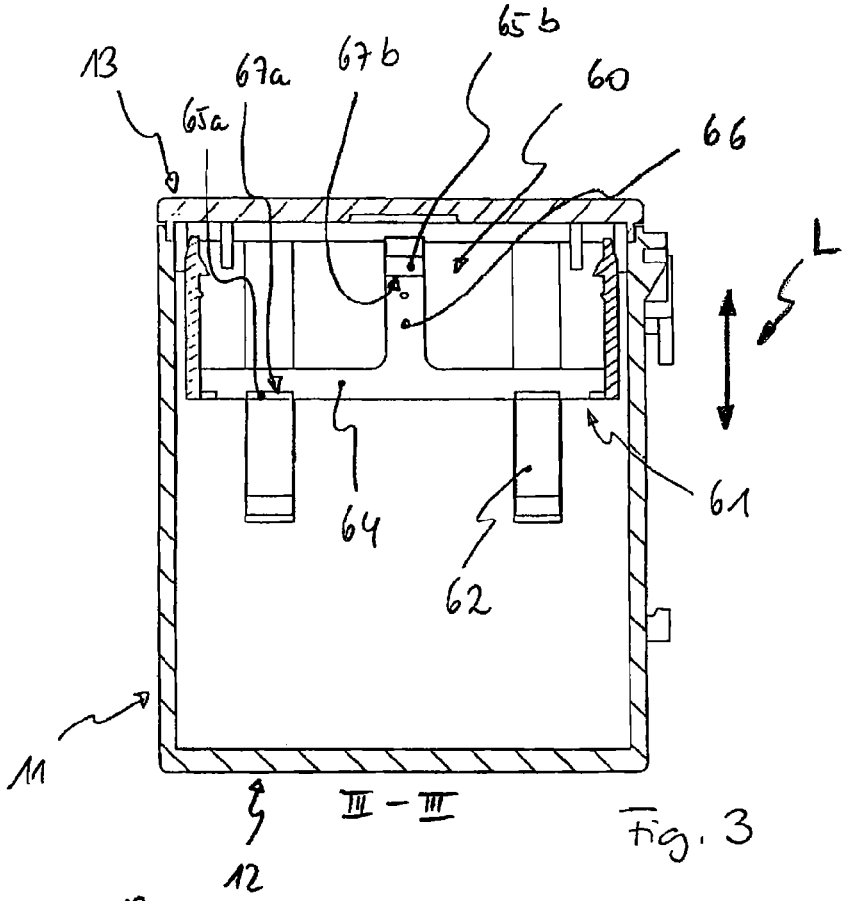
FIG. 3 is a sectional view of the fan heater housing according to the fan heater of the first embodiment, corresponding to a sectional plane III-III from FIG. 2.
Figure 4:
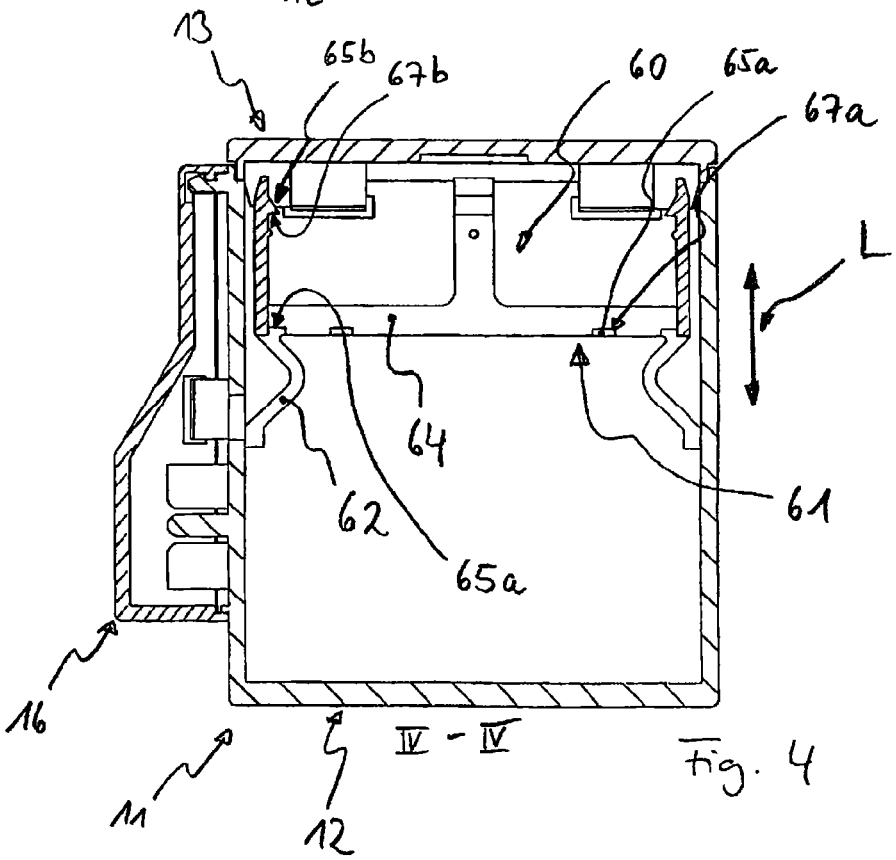
FIG. 4 is a sectional view of the fan heater according to the fan heater of the first embodiment, corresponding to a sectional plane IV-IV from FIG. 2.

FIG. 3 shows the fan heater housing 11 according to the fan heater of the first embodiment with the fixing element 60 in sectional view, corresponding to a sectional plane III-III from FIG. 2. A further sectional view according to the sectional plane IV-IV from FIG. 2 is shown in FIG. 4. FIG. 3 and FIG. 4 make clear the spacing of the seating element 61 from the housing walls. The special arched design of the resilient elements 62 is gleaned in particular from FIG. 4. Due to the arch-shape an adequate resilience of the elements on the seating element 61 may thus be achieved in a simple way and at the same time realize the spacing described earlier.

FIGS. 5, 6 and 7 show the fixing element 60 on its own in two different sectional front views and in one plan view. FIG. 5 shows the section along the intersection line V-V from FIG. 7, FIG. 6 portrays the section along the intersection line VI-VI, likewise from FIG. 7. In particular it is apparent from FIG. 7, that the resilient elements 62 cover both sides of the frame 64 in the extending planes of the frame 64. As a result the spacing of the seating element 61 from the housing 11 may be achieved.

Figure 8:
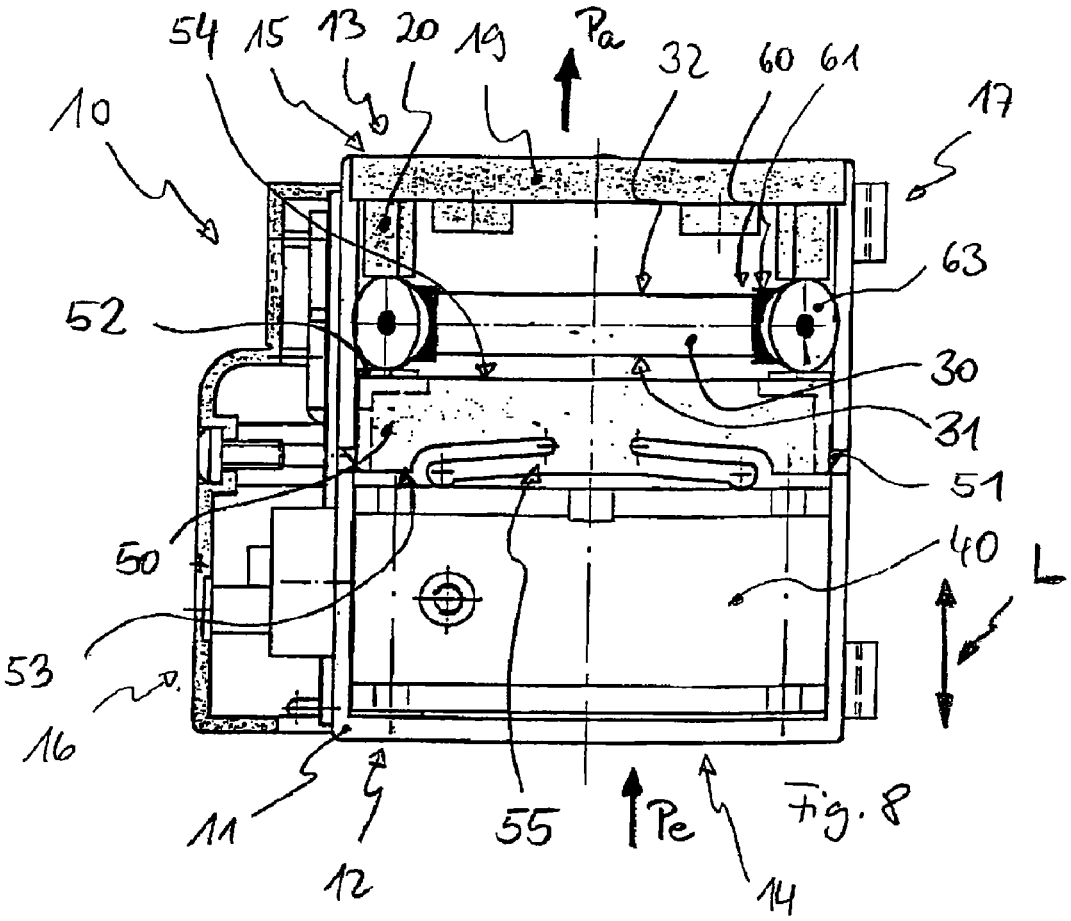
FIG. 8 is a side view of a fan heater shown in section in a second preferred embodiment with view of a fixing element for mounting a heating element.

FIG. 8 shows a sectional side view of a fan heater 10 in a second preferred embodiment with a view of a fixing element 60 for mounting a heating element 30. A housing 11 corresponds essentially to the housing according to the first embodiment, therefore in relation to this please refer to the above description.

The heating element 30 is here provided as a PTC element and designed as a filigree, mesh-like honeycomb body, which enables an adequately high air flow through the fan heater on account of its mesh structure.

In FIG. 8 the layer structure of the fan heater 10 is illustrated. A blower 40, an air deflector panel 50, the anti-vibration mounted heating element 30 and an upper guard screen 19 are mounted above one another in the housing 11. A lower guard screen (not visible) is preferably designed integrally with the housing 11. The blower 40 is mounted in the housing 11, overlapping directly the lower guard screen. The air deflector panel 50 is placed on the blower 40, e.g. an axial fan. This is anchored in the housing 11 by means of pins 51, so that a displacement of the air deflector panel in the longitudinal direction L, but also its transverse displacement in the housing 11, is able to be avoided. The air deflector panel 50 exhibits a spring device 55 on a lower surface 53, specific to the longitudinal direction L of the housing, which presses upon the blower 40 and this is consequently located in the housing 11 without play. Moreover protruding elements or seating surfaces 52 are provided on the air deflector panel 50 on an upper surface 54 specific to the longitudinal direction L of the housing, in order to seat the anti-vibration mounted heating element 30 on these. The heating element 30 in this embodiment is mounted in a fixing element 60, which includes a number of separate seating elements 61. The seating elements 61 are fixed directly to the heating element 30 and are supported on springs 63 on the housing 11 and/or on additional components of the fan heater. The heating element 30 equipped in this manner with fixing element 60 overlaps, as mentioned previously, the protruding elements 52 of the air deflector panel 50 on the extending springs 63 on lower surface 31 of the heating element 30. Simultaneously the upper guard screen 19 overlaps protruding elements or pegs 20 on one lower surface of the guard screen 19 and also (overlaps) the springs 63 which extend over an upper surface 32 of the heating element 30. As a result the heating element 30 is clamped between the air deflector panel 50 and the guard screen 19, wherein the direct contact between the springs 63 and the air deflector panel 50 and the guard screen 19 is able to be achieved via the protruding elements 20, 52, which are designed integrally with these. Upper and lower surfaces are defined respectively with reference to the longitudinal direction L of the housing.

The PTC element 30 is spaced from the housing 11 on account of the seating elements 61 designed with springs 63 and is mounted elastically to it. Since the heating element 30 is provided essentially as a square plate in this embodiment, one seating element 61 is attached to corresponding springs 63 at one corner of the heating element respectively. This guarantees an adequately secure retention of the heating element 30 at the same time with anti-vibration mounting. The anti-vibration mounting in this case also enables the external influences transmitted from the housing, e.g. impacts, to the heating element 30 to be neutralized, since the springs 63 can cushion any impacts transmitted via the housing 11. The protruding elements 52, 20 on the air deflector panel 50 and on the upper guard screen 19 are preferably designed integrally with these and/or as separate elements able to be attached to these.

Basically it is possible to design only one protruding element 20, 52 in each case on the upper guard screen 19 and/or on the air deflector panel 50. The guard screen or the air deflector panel would then be designed with a frame which would be placed on or be able to be placed on, as a protruding element, wherein the heating element would then be clamped over the frame. The frame may be provided as a separate element or equally designed integrally with the guard screen or the air deflector panel.

To clamp the mounted heating element it is possible alternatively to employ additional separators instead of the air deflector panel and/or the upper guard screen. The separators are then mounted completely inside the housing and are supported by themselves or on the other hand by the housing or other fan heater components.

In the embodiment according to FIG. 8 the springs 63 are designed as disc elements or as hemispherical elements, which extend over the lower surface 31 as well as over the upper surface 32 of the heating element 30. The disc elements are accordingly fixed via their respective centre points to the seating elements 61 and as a result to the heating element 30. Hence these act as bearing surfaces on both sides. Alternatively it is possible that the heating element will exhibit seating elements and springs on its lower surface as well as on its upper surface.

Figure 9:
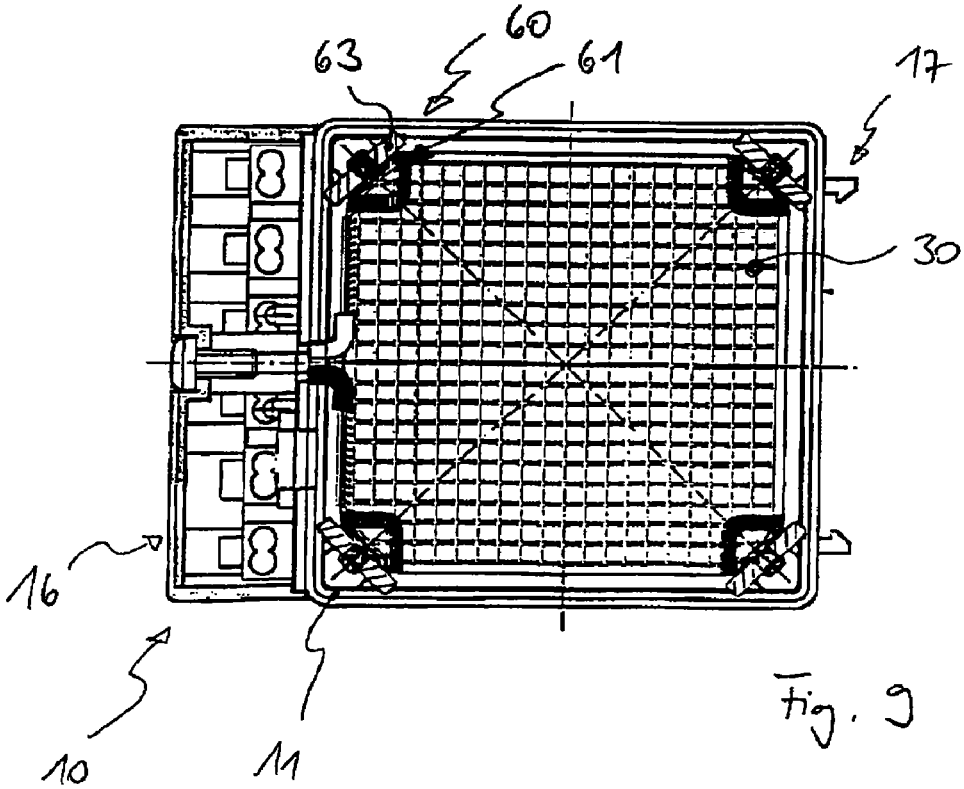
FIG. 9 is a plan view of the fan heater shown in section according to the second embodiment.

FIG. 9 shows a sectional plan view of the fan heater 10 according to the second embodiment with the fixing element 60. In this case the upper guard screen is removed, so that the heating element 30 is visible. Here the heating element is designed as a PTC element and exhibits a mesh-like structure. On account of this design as a honeycomb body an adequate airflow through the fan heater is enabled, wherein the honeycomb body exhibits low airflow impedance. The fixing element 60 encloses the seating elements 61 and the springs 63 attached to these, at the four corners of the disc-shaped heating element 30, wherein the springs are shown in section. Each seating element 61 exhibits at one end, for example, a kind of beaked opening, within which to mount the heating element. At another end as an example a pinhead-shaped peg or similar device is provided on the seating element 61. The disc-shaped springs 63 shown in section exhibit a hole at each of their centre points, so that the springs are able to be placed on the respective seating elements 61 via the pinhead-shaped pegs without problems. A head-shaped end of the peg prevents the respective springs 63 from slipping out of the corresponding seating element 61.

The blower 40 draws air e.g. at the lower surface 12 of the fan heater 10 via an air intake hole 14 in arrow direction Pe. The air deflector panel 50 helps to achieve an adequate air feed and air turbulence in the fan heater 10. As a result it is guaranteed that the air drawn by the blower 40 is fed through the fan heater 10 in an appropriate manner. The air taken in is heated by the heating element 30, so that this is expelled in the heated condition via an air exit port 15 into the surrounding area in the arrow direction Pa. Essentially the airflow can also be blown in the opposite direction.

Figure 10:
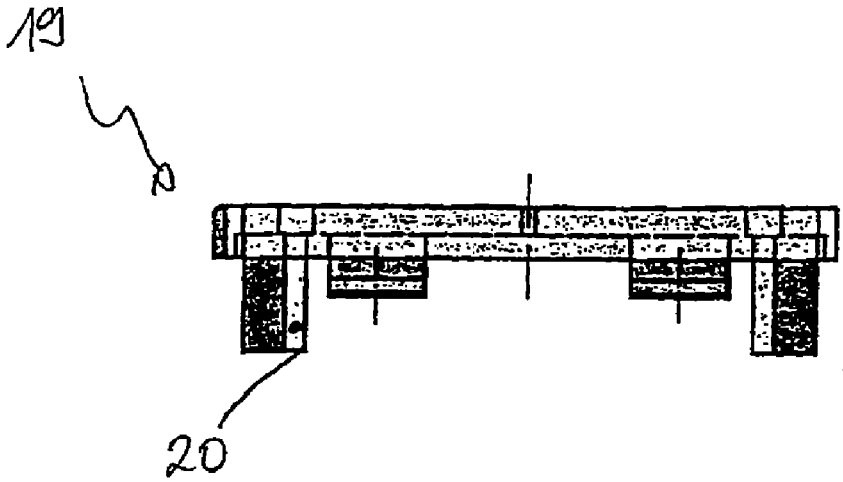
FIG. 10 is a side view of a guard screen for the fan heater according to the second embodiment.
Figure 11:
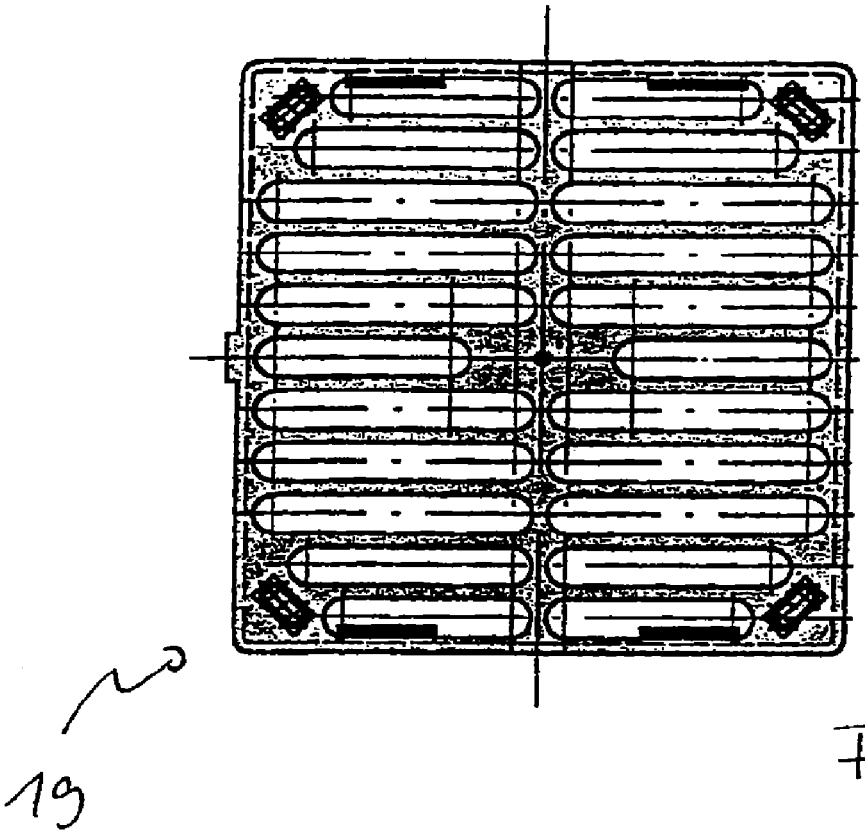
FIG. 11 is a plan view of the guard screen for the fan heater according to the second embodiment.

FIGS. 10 and 11 show the upper guard screen 19 for the fan heater 10 according to the second embodiment. FIG. 10 illustrates a side elevation, while FIG. 11 shows the guard screen in plan view. In particular FIG. 10 shows clearly the protruding elements 20, which in this embodiment are integrally formed onto the lower surface of the screen. The guard screen 19 overlaps the pegs 20 on the springs 63 of the fixing element 60 for the heating element 30. At the same time the screen 19 protects the fixing element 60 against intrusion into the fan heater interior 10.

It should be pointed out, that the embodiment described above is not only able to be employed on its own. On the contrary, the embodiment may also be utilized cumulatively, i.e. that for example a fan heater housing designed with the anti-vibration frame for retaining a heating element provided with seating elements and springs may be designed. As a result the initial impacts are in fact able to be attenuated by the anti-vibration mounting of the frame. The springs arranged on the heating element then form additional protection. Such a solution is offered in particular for very heavily loaded fan heaters.

As may be gleaned in particular from FIG. 9, the housing in this embodiment exhibits a fastening device 17 for retaining an adapter plate 70*a*, 70*b*, on an outer side, as they are shown in FIGS. 12, 13, 14 and 15. The adapter plates 70*a*, 70*b* exhibit respectively a fastening element 71, 72, so that the fan heater 10 may be fixed at a place intended for this, for example in a switching cabinet, by means of this fastening element 71, 72. The fastening device 17 on the fan heater 10 housing 11 is in this case designed as locating hooks, via which an adapter plate 70*a*, 70*b* respectively may be hung for example on the housing wall. At the same time the adapter plates 70*a*, 70*b* exhibit respectively a corresponding counterpart, in fact at least one protrusion and/or at least one recess. Alternatively it is, possible to screw the adapter plates 70*a*, 70*b* to the housing 11.

FIG. 12 illustrates the front view of an adapter plate 70*a* designed with a leaf spring 71 for attaching to the fan heater housing 11. FIG. 13 shows the adapter plate 70*a* in a side view. A further adapter plate 70*b* is to be seen from FIG. 14, wherein a second fastening element is shown, in fact in this case two slots 72. FIG. 15 shows this adapter plate 70*b* also in a side view. If various adapter plates with different fastening elements are provided, the suitable fastening element can be selected according to requirement and be fixed via the appropriate adapter plate to the housing 11 of the fan heater 10.

The leaf spring enables the fan heater 10 provided with the adapter plate 70*a* to be clip-fastened at the desired place, e.g. at a rail in the switching cabinet designed for this purpose.

The fan heater provided with the adapter plate can be screwed to the appropriate place by means of the slots 72.

As seen particularly from FIG. 1 and described above, in this case the fastening device 17 is designed in the housing such that it serves simultaneously as a fastening element. The fastening device 17 (not illustrated fully here) can be provided for by the flexible and/or foldable leaf spring 71, in order to locate the fan heater 10 directly in the desired place. An additional adapter plate is no longer necessary in this case.

Preferably the seating element or the seating elements 61 of the fixing element 60 in the embodiment shown here are made of plastics. Plastics materials are extremely stable and break-proof materials with at the same time low bulk. To that extent seating elements 61 made from plastics can guarantee a secure retention of the heating element 30 and be elastically mounted without problems.

Preferably the resilient elements 62 according to the first embodiment are designed from plastics. Plastics enables a stable design of anti-vibration components with at the same time low bulk. The springs 63 according to the second preferred embodiment are also for example designed from plastics, e.g. from an elastomer, such as rubber or silicone.

The resilient elements 62 integrally formed on the frame 64 along with the spring device 55 of the air deflector panel 50 are preferably designed respectively integrally with each other, so that the resilient elements 62 and the frame 64 along with the spring device 55 and the air deflector panel 50 are fabricated respectively from the same material. A spring device provided as a separate element can also be designed for example as at least one metallic helical spring or similar anti-vibration element. A disc spring or a disc spring assembly is suitable for (realizing) a blower mounting free from play by means of the spring device.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. Fan heater, including housing through which air is able to flow in a longitudinal direction, blower to propel the air, at least one heating element mounted elastically in the housing by means of a fixing element, the heating element being a positive temperature coefficient (PTC) element and being mounted separately from the blower in the housing, wherein the fixing element includes at least one seating element connected to the heating element, which is mounted elastically in relation to the housing, and wherein the seating element includes a frame having clips to which the heating element is snapped and thereby connected firmly to the frame.

2. Fan heater according to claim 1, wherein the seating element comprises lower clip elements and upper clip elements, the lower clip elements being formed directly on the frame and the upper clip elements being spaced from the frame by at least one spacing element formed on the frame.

3. Fan heater according to claim 2, wherein the lower clip elements and the upper clip elements are arranged alternately on the frame.

4. Fan heater according to claim 1, wherein the frame comprises resilient elements attached to the frame for fixing resiliently on the housing.

5. Fan heater according to claim 4, wherein the resilient elements are formed integrally with the frame.

6. Fan heater according to claim 4, wherein the resilient elements are separate elements, secured to the frame.

7. Fan heater according to claim 4, wherein the resilient elements are locked in locating devices in the housing.

8. Fan heater according to claim 4, wherein the frame is fixed to two opposing walls of the housing and two resilient elements are provided for connecting the frame to each wall.

9. Fan heater according to claim 4, wherein the resilient elements are comprised of plastic.

10. Fan heater according to claim 1, wherein the fixing element includes a plurality of separate seating elements, which are attached to the heating element and which are supported on spring means against the housing.

11. Fan heater according to claim 10, wherein the spring means are retained against longitudinal displacement in the housing by at least one separator which is inserted in the housing.

12. Fan heater according to claim 11, wherein the separator is a guard screen.

13. Fan heater according to claim 11, wherein the separator is an air deflector panel.

14. Fan heater according to claim 11, wherein the separator comprises protruding elements to retain the spring means.

15. Fan heater according to claim 13, wherein the air deflector panel retains the blower against the longitudinal displacement in the housing.

16. Fan heater according to claim 13, wherein the air deflector panel comprises a biasing device for bracing the blower in the housing.

17. Fan heater according to claim 1, wherein at least one wall of the housing comprises on an outer side thereof, at least one fastening device to retain an adapter plate having at least one fastening element for fixing the fan heater to a place intended for it.

18. Fan heater according to claim 10, wherein the spring means are comprised of plastic.

19. Fan according to claim 18, wherein the plastic is an elastomer.

20. Fan heater according to claim 1, wherein the seating element is comprised of plastic.

21. Fan heater according to claim 1, wherein the PTC element has a honeycomb body.

22. Assembly, including a fan heater according to claim 1, comprising:

at least two adapter plates each having at least one fastening element, respectively, for fixing the fan heater to a place intended for it and means for fixing one of the adapter plates to the housing of the fan heater.

23. Assembly according to claim 22, wherein the fastening element comprises at least one selected from the group consisting of a leaf spring adapted to provide a clip fastening and at least one slot for at least one screw fixing.

24. Assembly according to claim 22, wherein the means for fixing the adapter plates include at least one locating hook on the housing of the fan heater and at least one selected from the group consisting of a recess and a protrusion on the adapter plates as a counterpart for said locating hook.

* * * * *

UNITED STATES PATENT AND TRADEMARK OFFICE

CERTIFICATE OF CORRECTION

PATENT NO. : 7,664,379 B2
APPLICATION NO. : 11/720245
DATED : February 16, 2010
INVENTOR(S) : Hartmut Eisenhauer It is certified that error appears in the above-identified patent and that said Letters Patent is hereby corrected as shown below:

Title Page at item (73):

The address for assignee should read: -- Schwäbisch Hall (DE) --.

Signed and Sealed this

Thirty-first Day of August, 2010

David J. Kappos

David J. Kappos
*Director of the United States Patent and Trademark Office*